United States Patent [19]

Newcomb

[11] Patent Number: 4,993,473

[45] Date of Patent: Feb. 19, 1991

[54] DIFFERENTIAL PRESSURE, COUNTERGRAVITY CASTING USING MOLD INGATE CHILLS

[75] Inventor: Thomas P. Newcomb, Defiance, Ohio

[73] Assignee: General Motors Corporation, Detroit, Mich.

[21] Appl. No.: 559,319

[22] Filed: Jul. 30, 1990

[51] Int. Cl.[5] ..... B22D 15/00; B22D 18/06

[52] U.S. Cl. ..... 164/63; 164/127; 164/255; 164/352

[58] Field of Search ..... 164/63, 119, 122, 127, 164/352, 255, 306

[56] References Cited

U.S. PATENT DOCUMENTS 4,340,108 7/1982 Chandley et al. ..... 164/63

4,520,858 6/1985 Ryntz, Jr. et al. ..... 164/127 X

FOREIGN PATENT DOCUMENTS 64-22460 1/1989 Japan ..... 164/63

*Primary Examiner*—Richard K. Seidel

*Assistant Examiner*—J. Reed Batten, Jr.

*Attorney, Agent, or Firm*—Reising, Ethington, Barnard, Perry & Milton

[57] ABSTRACT

Molten metal is differential pressure, countergravity cast into a casting mold having a heat conductive chill meter disposed in the ingate to the mold cavity. The chill member accelerates solidification of a plug of the metal in the ingate in the vicinity of the chill member after the mold cavity is filled with molten metal. The plug prevents run-out of molten metal from the mold cavity when the ingate and an underlying molten metal source are disengaged after casting. Accelerated solidification of the plug in the ingate permits early disengagement of the ingate and the molten metal source to shorten casting cycle time.

15 Claims, 3 Drawing Sheets

DIFFERENTIAL PRESSURE, COUNTERGRAVITY CASTING USING MOLD INGATE CHILLS

Field Of The Invention

This invention relates to an apparatus and method for the differential pressure, countergravity casting of molten metal in such a manner as to accelerate solidification of a plug of the metal in the mold ingate(s) to permit early disengagement of the mold from an underlying molten metal source and thereby shorten casting cycle time.

BACKGROUND OF THE INVENTION

A vacuum-assisted, countergravity casting process using a gas permeable mold sealingly received in a vacuum housing is described in the Chandley et al U.S. Pat. No. 4,340,108. That countergravity casting process involves providing a mold having a porous, gas permeable upper mold member (cope) and a lower mold member (drag) sealingly engaged at a parting plane, sealing the mouth of a vacuum housing to a surface of the mold such that a vacuum chamber confronts the gas permeable upper mold member, immersing the underside of the lower mold member in an underlying molten metal pool and evacuating the vacuum chamber to urge the molten metal upwardly through one or more ingates (also referred to as pin gates) in the lower mold member into one or more mold cavities formed between the upper and lower mold members.

The ingates are so sized (e.g., typically less than 0.25 inches in diameter) to effect relatively rapid initial solidification of the molten metal in the ingate(s) prior to substantial solidification of the molten metal in the mold cavity. Once a plug of the metal is solidified in the ingate(s), the metal-filled mold can be withdrawn from the underlying pool without molten metal run-out from the mold cavity. The time that the mold ingates must remain immersed in the pool is thereby reduced and shortens the casting cycle time.

Since mold ingate immersion times in the molten metal pool (e.g., an iron melt) are on the order of only about 15 to 20 seconds using this process, the reduction of even a few seconds in the mold immersion time is appreciable and results in increased production of cast parts at lower cost.

Accordingly, it is an object of the present invention to provide an apparatus and method for the differential pressure, countergravity casting of molten metal wherein the time required for engagement between the mold ingate(s) and an underlying molten metal source is reduced to shorten casting cycle time and improve production economies.

It is another object of the present invention to provide an apparatus and method for the differential pressure, countergravity casting of molten metal wherein a chill member is disposed in the mold ingate(s) to accelerate solidification of a plug of the metal therein after the mold cavity is filled with the melt and before the mold ingate(s) and the molten metal source are disengaged.

SUMMARY OF THE INVENTION

The present invention contemplates an apparatus and method for the differential pressure, countergravity casting of molten metal into a mold having a mold cavity, at least one ingate for engaging an underlying source of the molten metal so as to communicate the mold cavity and the source, and a heat conductive chill member disposed in the ingate to accelerate heat removal from the molten metal in the ingate after the mold cavity is filled with the molten metal. The chill member promotes rapid solidification of a plug of the metal in the ingate in the vicinity of the chill member after the mold cavity is filled with the molten metal. The solidified plug prevents run-out of molten metal in the mold cavity upon subsequent disengagement of the mold ingate and the molten metal source. Accelerated solidification of the plug in the ingate permits early disengagement of the mold and the molten metal source to shorten the casting cycle time and improve production economies.

In one embodiment of the present invention, the chill member is embedded in the mold about the ingate with a molten metal passage of the chill member in flow communication with the ingate. The chill member thereby promotes accelerated solidification of the metal plug in the passage therein.

The location, configuration and thermal properties of the chill member are selected to provide a desired accelerated ingate "freeze-off" as appropriate for a particular casting application. The chill member will preferably comprise a metal which has a high thermal conductivity, has a melting point higher than that of the melt being cast and is substantially insoluble in the melt being cast. Such chills may be recovered and reused. Hence, for example, a chill member comprising nickel is considered useful for casting gray iron, nodular iron or steel. Alternatively, the chill may comprise the same material as is being cast.

In a method embodiment of the present invention, the chill member is embedded in the mold about the ingate by positioning the chill member on a removable ingate-forming pattern, placing mold material about the chill member, the ingate-forming pattern and a mold-cavity forming pattern, and then removing the patterns from the mold material to form the mold cavity and the ingate in the mold material with the chill member embedded therein about the ingate.

The aforementioned objects and advantages of the present invention will become more readily apparent from the detailed description taken with the following drawings.

DETAILED DESCRIPTION OF SPECIFIC EMBODIMENTS

Figure 1:
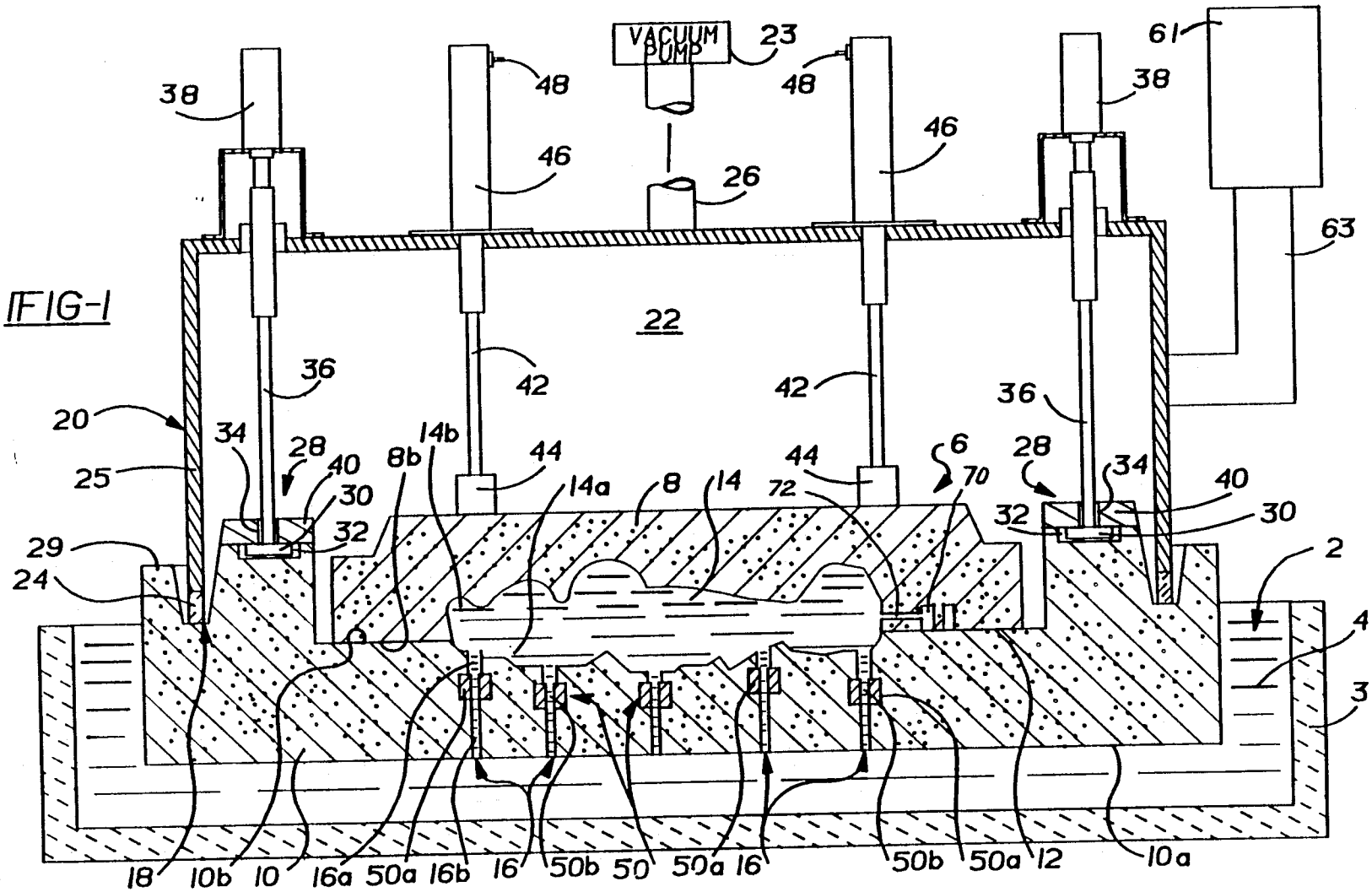
FIG. 1 is a sectioned, side view of a differential pressure, countergravity casting apparatus in accordance with the invention after the mold cavity is filled with the molten metal but before the plugs of metal are solidified in the ingates.

FIG. 1 depicts a pool 2 (i.e., a source) of molten metal 4 which is to be drawn up into a mold 6 having a gas-permeable upper mold portion 8 (cope) and a lower mold portion 10 (drag) joined at a parting line 12 and defining a molding cavity 14 therebetween. The molten metal 4 is contained in a casting furnace or vessel 3 heated by one or more induction coils (not shown) to maintain the molten metal 4 at a desired casting temperature; e.g., about 2600° F. for nodular iron.

The lower mold portion 10 includes a plurality of narrow ingates 16 (also known as pin gates) communicating the underside 10*a* thereof with the mold cavity 14 for admitting the molten metal 4 to the mold cavity 14 when it is evacuated through the upper mold portion 8 with the underside 10*a* immersed in the pool 2.

The lower mold portion 10 of the mold 6 is sealed to the mouth 18 of a vacuum box 20 defining a vacuum chamber 22 via a compressible seal 24 (e.g., high temperature rubber, ceramic rope, etc.). The seal 24 is affixed to the lower peripheral edge of the depending peripheral side 25 of the vacuum box 20. The vacuum chamber 22 confronts the upper mold portion 8 and communicates with a vacuum source 23 (e.g., a vacuum pump) via conduit 26.

The upper mold portion 8 comprises a gas-permeable material (e.g., resin-bonded sand) which permits gases to be withdrawn from the casting cavity 14 when a vacuum is drawn in the chamber 22. The lower mold portion 10 may conveniently comprise the same material as the upper mold portion 8 or other materials, permeable or impermeable, which are compatible with the material of the upper mold portion 8. The lower mold portion 10 includes an upstanding levee 29 surrounding the seal 24 and isolating it from the melt 4 as described in U.S. Pat. No. 4,745,962 and assigned to the assignee of the present invention. The lower mold portion 10 also includes a plurality of anchoring sites 28 engaged by T-bar keepers 30 of the type described in commonly assigned U.S. Pat. No. 4,932,461 which provides means for mounting the mold 6 to the vacuum box 20. As described in those patent applications, the lower mold portion 10 includes a plurality of anchoring cavities 32 adapted to receive the T-bar keepers 30 via slots 34 in the shelves 40 overlying the anchoring cavities 32 and attached to the lower mold portion 10. A 90° rotation of the T-bar carrying shafts 36 (e.g., by air motors 38) causes the T-bar keepers 30 to engage the underside of the attached shelves 40 overhanging the cavities 32 to secure the mold 6 to the box 22. Other known mold-to-vacuum box mounting means can also be employed in practicing the invention (e.g., see U.S. Pat. No. 4,658,880).

The upper mold portion 8 is pressed into sealing engagement with the lower mold portion 10 (i.e., at the parting line 12) by means of a plurality of plungers 42 so as to eliminate the need to glue the upper mold portion 8 and the lower mold portion 10 at the parting plane 12. Feet 44 on the ends of the plungers 42 distribute the force of the plungers 42 more widely across the top of the upper mold portion 8 to prevent penetration/puncture thereof by the ends of the plungers 42. Pneumatic springs 46 bias the plungers 42 downwardly to resiliently press the upper mold portion 8 against the lower mold portion 10 as the mold 6 is being positioned in the mouth 18 of the vacuum box 22. Schrader valves 48 on the air springs 46 permit varying the pressure in the springs 46 as needed to apply sufficient force to press the upper mold portion 8 into sealing engagement with the lower mold portion 10, and, as needed, to prevent destructive inward flexure of the mold 6 when the casting vacuum is drawn. The force applied by the plungers 42, however, will not be so great as to overpower and damage the anchoring sites 28, dislodge the mold 6 from the mouth 18 of the box 20, or break the seal formed thereat.

Figure 2:
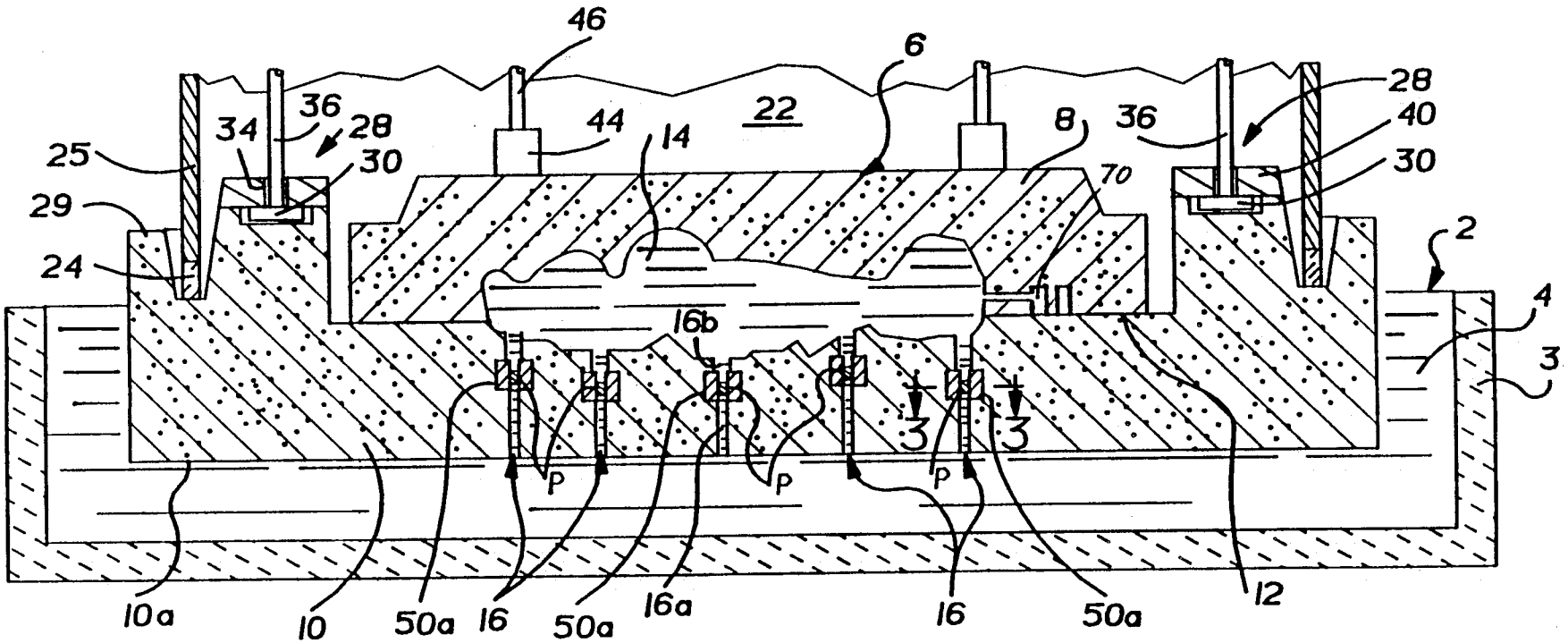
FIG. 2 is a fragmentary view of FIG. 1 after the mold cavity is filled with the molten metal and after solidification of the plugs of the metal in the ingates.

In accordance with one embodiment of the invention for countergravity casting of the molten metal 4, a heat conductive chill member 50 is disposed in each ingate 16 between the underside 10*a* of the lower mold portion (drag) 10 and the mold cavity 14 as shown best in FIGS. 1 and 2. Each chill member 50 is shown as a tubular, cylindrical body 50*a* having a cylindrical molten metal passage 50*b* extending axially or longitudinally therethrough. The molten metal passage 50*b* has a circular cross-section as shown best in FIG. 3.

Each chill member 50 is embedded in the drag 10 about a respective ingate 16 such that the molten metal passage 50*b* is in flow communication with a relatively large diameter, upper ingate portion 16*a* (e.g., about 0.3125 inch diameter) and a smaller diameter, lower ingate portion 16*b* (e.g., about 0.1875 inch diameter) to provide a flow path for the molten metal 4 to be drawn upwardly from the pool 2 into the mold cavity 14. The diameters of the lower ingate passages 16*b* and the chill member passages 50*b* are generally equal in this embodiment. In general, the chill member passages 50*b* will have a diameter (or other major dimension) not exceeding about 0.50 inch, preferably not exceeding about 0.25 inch (e.g., 0.1875 inch diameter), for purposes set forth in the U.S. Pat. No. 4,340,108 and hereinafter described.

Figure 4:
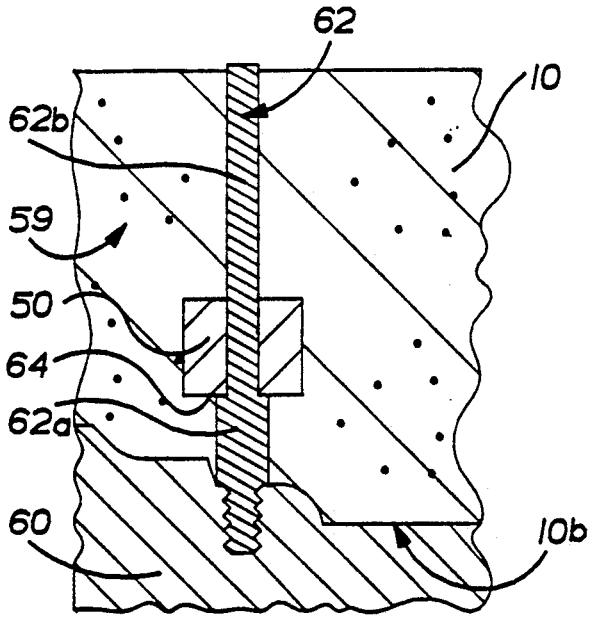
FIG. 4 is a fragmentary, sectioned, side view of a mold cavity-forming pattern, an ingate-forming pattern and a chill member positioned on the ingate-forming pattern with mold material placed about the patterns.

Referring to FIG. 4, the lower mold member 10 is made of resin-bonded sand in accordance with known mold practice wherein a mixture 59 of sand or equivalent particles and bonding material is formed to shape and cured or hardened against a metal pattern plate 60. The pattern plate 60 constitutes a mold cavity-forming pattern having the desired complementary contour or profile for forming the parting surface 10*b* on the drag 10 as well as the desired shape of the lower portion of the mold cavity 14. The bonding material may comprise inorganic or organic thermal or chemical setting plastic resin or equivalent bonding material. The bonding material is usually present in minor percentage, such as less than about 5% by weight of the mixture.

Prior to forming the sand-binder mixture on the pattern plate 60, a plurality (only one shown) of ingate-forming patterns 62 are placed in desired positions on the pattern plate 60 with a respective chill member 50 disposed on each ingate-forming pattern 62. The patterns 62 are screw threaded into the pattern plate 60 or otherwise held in position thereon. Each chill member 50 is positioned at the desired position along the length of each ingate-forming pattern 62 by locating on the annular shoulder 64 formed between the large and small diameter portions 62*a*,62*b* of each ingate-forming pattern 62.

After the sand-binder mixture is formed on the pattern plate 60 about the ingate-forming patterns 62 and the chill members 50, the mixture is cured or hardened in known manner. The pattern plate 60 and the ingate-forming patterns 62 are then removed from the rigidized sand-binder mixture 59 to yield the lower mold portion (drag) 10 having the lower portion 14*a* of the mold cavity 14 formed therein at the parting surface 10*b* and communicated to the flat underside 10*a* via the ingates 16. Each chill member 50 is thereby embedded in the lower mold portion 10 about a respective ingate 16 as shown in FIGS. 1 and 2.

If necessary, the chill member passages 50*b* can be reamed with a suitable tool after fabrication of the lower mold portion 10 to remove any sand which may have worked its way between the chill members 50 and the ingate-forming patterns 62.

The upper mold portion 8 is also made of resin-bonded sand in accordance with the known mold practice described hereinabove using a suitable pattern plate (not shown) and mixture of sand and bonding material so as to include the upper portion 14*b* of the mold cavity 14 and a parting surface 8*b* to sealingly mate with the parting surface 10*b* of the lower mold portion 10 at the parting line 12. The upper mold portion 8 and lower mold portion 10 are mated together at the parting line 12 to provide the casting mold 6 having a complete mold cavity 14 defined between the upper and lower mold portions 8,10 as is apparent in FIGS. 1 and 2.

Countergravity casting of the mold 6 is effected by relatively moving the mold 6 and the pool 2 to immerse the underside 10*a* of the lower mold portion 10 in the molten metal 4 and evacuating the mold cavity 14 to urge the molten metal 4 upwardly through the ingates 16 into the mold cavity 14 to fill it with the molten metal 4. Typically, the mold 6 is lowered toward the pool 2 using a hydraulic power cylinder 61 (shown schematically) actuating a movable support arm 63 (shown schematically) that is connected to the vacuum box 20. FIG. 1 illustrates the underside 10*a* of the lower mold portion 10 immersed in the pool 2 and the mold cavity 14 filled with the molten metal 4.

Referring to FIG. 2, in accordance with the present invention, the molten metal 4 in the ingates 16 is in contact with the chill members 50 after the mold cavity 14 is filled and heat is rapidly extracted therefrom into the chill members 50 to accelerate solidification of the plugs P of the metal in each passage 50*b* (that is, to accelerate ingate "freeze-off"). The configuration and thermal properties of the chill members 50 as well as their vertical location relative to the mold cavity 14 and the underside 10*a* of the drag 10 are selected to effect ingate "freeze-off" at the same general time after the mold cavity 14 is filled with the molten metal 4. Solidification of the plugs P occurs before the molten metal 4 in the mold cavity 14 and in the ingates 16 above and below the plugs P substantially solidifies.

Figure 3:
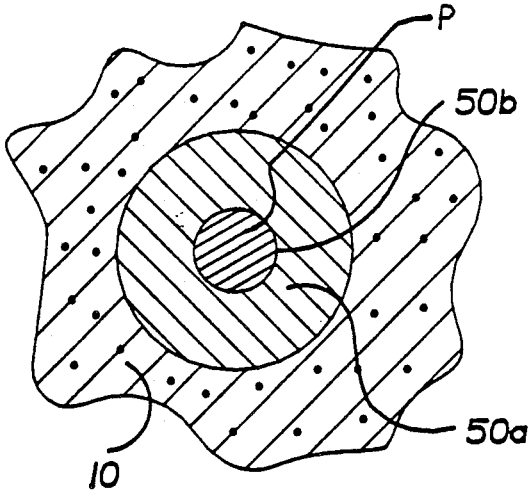
FIG. 3 is a fragmentary sectioned view taken along lines 3—3 of FIG. 2.

For the tubular, cylindrical chill members 50 shown in FIGS. 1–3, the length, internal diameter and outer diameter of the chill members 50 can be appropriately selected to provide sufficient heat extracting rate to achieve the desired accelerated ingate "freeze-off" in the passages 50*b*. A length to internal diameter ratio of about 6 or greater may be suitable. Minimum ingate "freeze-off" times should occur when the outer periphery of each chill member 50 has not yet begun to increase in temperature at the time of solidification of the plugs P in the passages 50*b*.

The heat conductivity of the chill members 50 also affects ingate "freeze-off" time. Various materials may find use for the chill members 50 depending upon the molten metal 4 being cast and can be selected as required to achieve the desired ingate "freeze-off" time. The chill members 50 are made of a material which is essentially insoluble in the molten metal 4 at the casting temperature and time-of-contact (between the chill member and molten metal) involved so that the chill members 50 are not substantially destroyed during the casting process. That is, the chill members 50 are not substantially dissolved or otherwise expended by contact with the molten metal 4 during the time of mold filling and of solidification of the plugs P. In casting molten cast iron, chill members 50 made of cast iron may prove adequate in this regard. Preferably, however, in the countergravity casting of molten iron (e.g., nodular iron), chill members 50 made of nickel will provide satisfactory heat conductivity for accelerating solidification of the plugs P in the passages 50*b* of the chill members 50, will not melt or dissolve in the iron and may be readily recovered from the discarded mold material and reused.

Once the plugs P solidify, the casting mold 6 can be raised (by arm 63) out of the pool 2 and transferred to a demold station (not shown) without run-out of the molten metal above the plugs P (i.e., the molten metal 4 in the mold cavity 14 and in the ingate portions 16*a* above the plugs P). However, any molten metal below the plugs P in the lower ingate portions 16*a* is free to drain by gravity into the underlying pool 2.

Moreover, as soon as the plugs P solidify in the chill members 50 with the underside 10*a* immersed in the pool 2, the relative vacuum in the vacuum chamber 22 optionally may be discontinued (i.e., ambient pressure can be provided in the vacuum chamber 22) and the metal-filled mold 6 then raised out of the pool 2 without run-out from the mold cavity 14. Discontinuance of the relative vacuum in the vacuum chamber 22 at that time can be advantageous when one or more risers or shrink bobs (not shown) are provided in the upper mold portion 8 above the mold cavity 14 and connected in flow relation to the mold cavity 14 to gravity feed the molten metal 4 thereto during solidification in the mold cavity 14. In particular, since the relative vacuum in the vacuum chamber 22 will oppose gravity feeding of molten metal 4 from the risers and/or shrink bobs to the mold cavity 14, termination of the relative vacuum in chamber 22 should facilitate feeding of the molten metal 4 from the risers and/or shrink bobs to the mold cavity 14 during solidification of the molten metal 4 therein to produce better quality castings.

Figure 5:
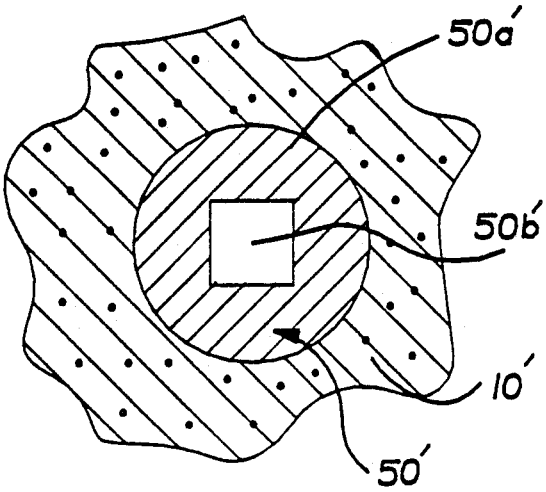
FIG. 5 is a fragmentary sectioned view similar to FIG. 3 illustrating a different configuration of the chill member.

Although FIGS. 1–3 illustrate each chill member 50 as having a cylindrical molten metal passage 50*b* in contact with the molten metal 4, other chill passage shapes can be used to provide greater chill surface area in contact with the molten metal 4 to accelerate solidification of the plugs P in the passages 50*b*. For example, referring to FIG. 5, a tubular chill member 50' having a molten metal passage 50*b'* with a parallelogram (e.g., square) cross-section is shown to provide a greater chill square area than the cylindrical passages 50*b* of FIGS. 1–3 for contacting the molten metal 4 therein after the mold cavity 14 is filled.

Figure 6:
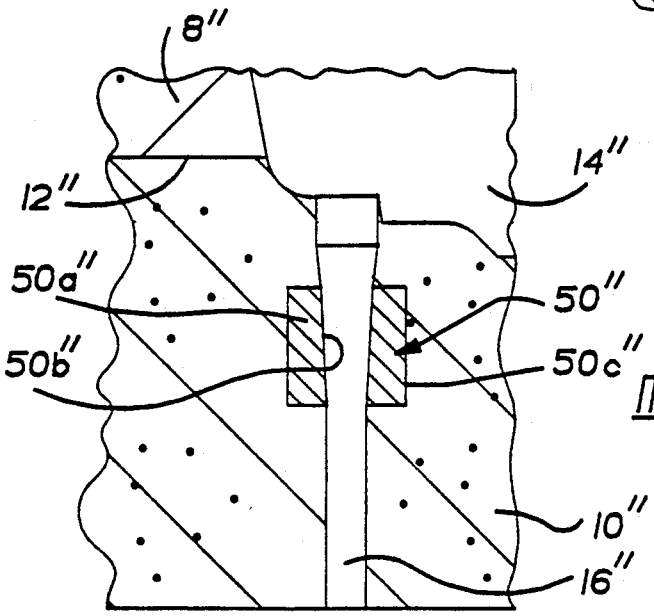
FIG. 6 is a fragmentary sectioned, side view illustrating a still different configuration of the chill member.

Also, referring to FIG. 6, a chill member 50'' having a body 50*a''* with a tapered outer periphery 50*c''* and tapered (frusto-conical) molten metal passage 50*b''* is shown. The tapered passage 50*b''* provides a greater chill surface area to contact the melt 4 than the molten metal passage 50*b* of FIGS. 1–3. Moreover, the tapered passage 50*b''* also provides smooth molten metal flow through the ingates 16 and increases the likelihood that each chill member 50'' can be removed from the solidified melt in the associated ingate 16'' and reused in other molds 6 to be subsequently cast.

Although in FIGS. 1–6 the chill members 50 are illustrated as unitary (one-piece) members, the invention is not so limited. Multi-piece chill members can be used.

Referring again to FIGS. 1 and 2, the upper mold portion 8 can be formed to include at the parting surface 8*b* one or more optional chill member-forming cavities 70 (only one shown) connected in flow relation to the mold cavity 14 via an associated horizontal runner 72. One or more chill member-forming cavities 70 and associated runners 72 can be used to produce new chill members 50 as each mold 6 is countergravity cast. A ready supply of new chill members 50 is thereby provided at minimal cost.

Although the invention has been described hereinabove with respect to immersing the mold underside 10*a* in the pool 2 of the molten metal 4, the invention is not so limited. Other sources of molten metal 4 can be used; e.g., a pressure-pour casting furnace can be used to bring the molten metal therein in engagement with an ingate of a casting mold.

Moreover, the invention is not limited for use with the resin-bonded sand casting mold 6. The invention may find use with other types of refractory molds; e.g., investment shell molds of the high temperature bonded ceramic type known in the art that comprise alumina, zircon, fused quartz and like ceramic particulate and binder, such as colloidal silica.

While the invention has been described in terms of specific embodiments thereof, it is not intended to be limited thereto but rather only to the extent set forth hereafter in the claims which follow.

I claim:

1. Apparatus for the differential pressure, countergravity casting of molten metal, comprising:

(a) a mold having a mold cavity and an ingate for engaging an underlying source of the molten metal to communicate the mold cavity with said source, (b) means for applying a sufficient differential pressure between the mold cavity and the source while the ingate engages the source to urge the molten metal upwardly through the ingate into the mold cavity to fill said mold cavity with the molten metal, and (c) a heat conductive chill member disposed in said ingate to accelerate solidification of a plug of the metal in the ingate in the vicinity of said chill member after the mold cavity is filled and before the ingate disengages the source for preventing run-out of the molten metal from the mold cavity upon subsequent disengagement of said ingate and said source, whereby accelerated solidification of said plug allows early disengagement of said ingate and said source after the mold cavity is filled.

2. Apparatus for the differential pressure, countergravity casting of molten metal, comprising:

(a) a mold having a mold cavity and an ingate communicating the mold cavity with a lower mold portion adapted for immersion in an underlying pool of the molten metal, (b) means for applying a sufficient differential pressure between the mold cavity and the pool while the lower mold portion is immersed in the pool to urge the molten metal upwardly through the ingate into the mold cavity to fill said mold cavity with the molten metal, and (c) a heat conductive chill member disposed in said ingate to accelerate solidification of a plug of the metal in the ingate in the vicinity of said chill member after the mold cavity is filled and before the lower mold portion is emersed from said pool for preventing run-out of the molten metal from the mold cavity upon subsequent removal of said lower mold portion from said pool, whereby accelerated solidification of said plug allows early removal of said lower mold portion from said pool after the mold cavity is filled.

3. The apparatus of claim 2 wherein the chill member is embedded in the mold about the ingate.

4. The apparatus of claim 3 wherein the chill member includes a molten metal passage in flow communication with said ingate.

5. The apparatus of claim 4 wherein the chill member promotes accelerated solidification of said plug in said passage.

6. The apparatus of claim 4 wherein said passage has a circular cross-section.

7. The apparatus of claim 4 wherein said passage has a parallelogram cross-section.

8. The apparatus of claim 2 wherein said chill member is reusable.

9. The apparatus of claim 8 wherein said chill member has a frusto-conical molten metal passage to facilitate removal from the metal solidified in the ingate.

10. The apparatus of claim 2 wherein said mold comprises a cope and a drag defining the mold cavity therebetween, said ingate and said chill member being disposed in the drag between the mold cavity and an underside of the drag.

11. A method of differential pressure, countergravity casting of molten metal, comprising:

(a) forming a mold having a mold cavity, an ingate for engaging a source of the molten metal to communicate the mold cavity with said source, and a heat conductive chill member in communication with the ingate, (b) relatively moving the mold and the source to engage the ingate and the source, (c) applying a sufficient differential pressure between the mold cavity and the source while the ingate and the source are engaged to urge the molten metal upwardly through the ingate into the mold cavity to fill said mold cavity with said molten metal, (d) extracting sufficient heat from the molten metal in the ingate via the chill member after the mold cavity is filled to accelerate solidification of a plug of the metal in the ingate in the vicinity of said chill member while the ingate and the source remain engaged for preventing run-out of the molten metal from the mold cavity upon subsequent disengagement of said ingate and said pool, and (e) disengaging the ingate and the source after formation of said plug in said ingate.

12. The method of claim 11 wherein the chill member is disposed about the ingate such that a molten metal passage of the chill member is in flow communication with said ingate.

13. The method of claim 12 wherein said plug is solidified in said passage.

14. The method of claim 11 wherein the mold is formed by positioning the chill member on a removable ingate-forming pattern, placing mold material about the chill member, the ingate-forming pattern and a mold cavity-forming pattern, and removing the patterns from the mold material to form the mold cavity and the ingate in said mold material with the chill member embedded in said mold material in communication with said ingate.

15. The method of claim 11 including forming a chill member-shaped molding cavity in the mold for receiving the molten metal in step (c) so as to produce a new chill member for positioning in another mold.

* * * * *

UNITED STATES PATENT AND TRADEMARK OFFICE

CERTIFICATE OF CORRECTION

PATENT NO. : 4,993,473

DATED : February 19, 1991

INVENTOR(S) : Thomas P. Newcomb

It is certified that error appears in the above-identified patent and that said Letters Patent is hereby corrected as shown below:

Item [57] Abstract:

Line 3, delete "meter" and insert --member-- therefor.

Signed and Sealed this

Fourteenth Day of September, 1993

Bruce Lehman

*Attest:*

BRUCE LEHMAN

*Attesting Officer*

*Commissioner of Patents and Trademarks*